US005889239A

United States Patent [19]

Blackaby et al.

[11] Patent Number: 5,889,239

[45] Date of Patent: Mar. 30, 1999

[54] METHOD FOR MONITORING ELEVATOR LEVELING PERFORMANCE WITH IMPROVED ACCURACY

[75] Inventors: Barry G. Blackaby, Avon; Timothy M. Remmers, New Hartford; William A. Wurts, Wethersfield, all of Conn.

[73] Assignee: Otis Elevator Company, Farmington, Conn.

[21] Appl. No.: 743,630

[22] Filed: Nov. 4, 1996

[51] Int. Cl.[6] ..... B66B 3/02

[52] U.S. Cl. ..... 187/391; 187/394

[58] Field of Search ..... 187/394, 393, 187/391

[56] References Cited

U.S. PATENT DOCUMENTS

| | | | |
|---|---|---|---|
| 4,245,721 | 1/1981 | Masel | 187/29 R |
| 4,346,788 | 8/1982 | Shung | 187/29 R |
| 4,362,224 | 12/1982 | Fairbrother | 187/29 R |
| 4,363,026 | 12/1982 | Salmon . | |
| 4,384,275 | 5/1983 | Masel et al. . | |
| 4,568,909 | 2/1986 | Whynacht | 187/29 R |
| 4,622,538 | 11/1986 | Whynacht et al. . | |
| 4,627,518 | 12/1986 | Meguerdichian | 187/29 R |
| 4,683,990 | 8/1987 | Wright | 187/394 |
| 5,135,081 | 8/1992 | Watt et al. | 187/394 |
| 5,247,139 | 9/1993 | Schon et al. | 187/394 |
| 5,274,203 | 12/1993 | Skalski et al. | 187/134 |
| 5,594,219 | 1/1997 | Kamani et al. | 187/394 |
| 5,631,452 | 5/1997 | Jamieson et al. | 187/394 |

FOREIGN PATENT DOCUMENTS 2736722 1/1997 France .

*Primary Examiner*—Karen M. Young
*Assistant Examiner*—Gregory A. Morse

[57] ABSTRACT

A method which provides for level monitoring of an elevator car within a hoistway at a plurality of floors by providing a plurality of sensed signals which is indicative of an elevator position of the elevator car relative to a plurality of targets having a plurality of light absorptive surfaces and a plurality of light interactive regions, the plurality of targets mounted within the hoistway at the plurality of floors. The plurality of sensed signals is processed to provide a leveling variable, a floor number variable and a direction of travel variable which indicate a direction of travel of the elevator car within the hoistway. The leveling variable, floor number variable and direction of travel variable are stored at a remote elevator monitoring central processor.

10 Claims, 6 Drawing Sheets

FIG.2
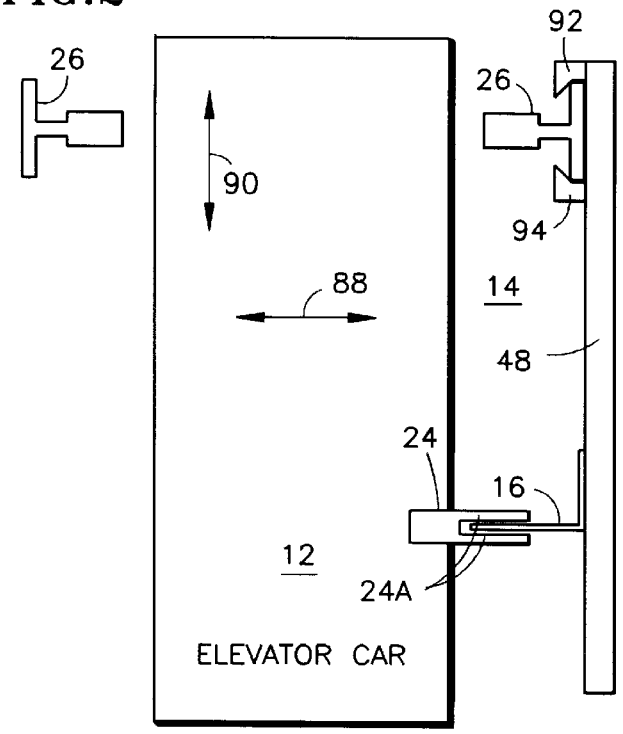
FIG.3A
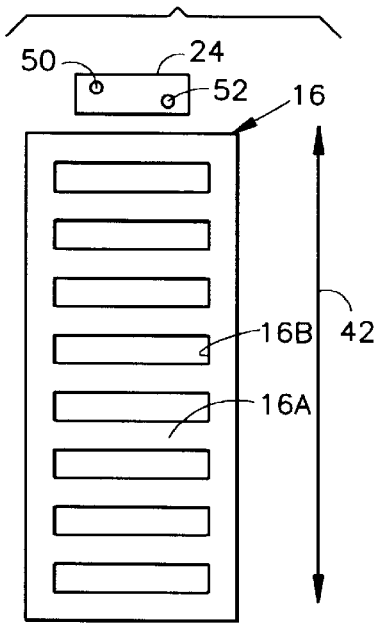
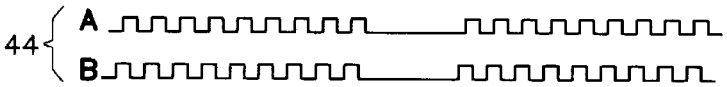
FIG.3C
28 BINARY SIGNAL
| 28A A | 28B B |
|---|---|
| 0 | 0 |
| 0 | 1 |
| 1 | 1 |
| 1 | 0 |
| 0 | 0 |
| 0 | 1 |
| 1 | 1 |
| 1 | 0 |
| 0 | 0 |
| 0 | 1 |
| 1 | 1 |
| 1 | 0 |
| 0 | 0 |
| 0 | 1 |
| 1 | 1 |
| 1 | 0 |
| 0 | 0 |
| 0 | 0 |
| 0 | 0 |
| 0 | 0 |
| 0 | 0 |
| 0 | 0 |
| 0 | 0 |
| 0 | 1 |
FIG.3B FIG.7A
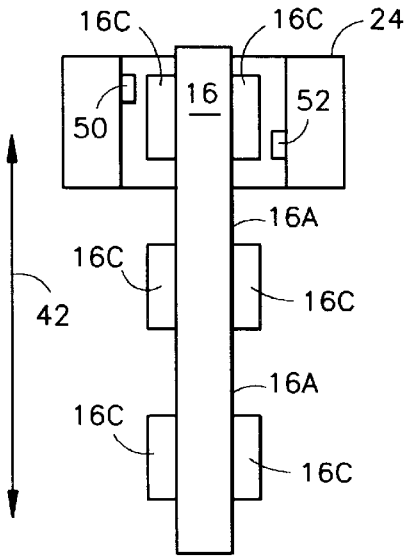
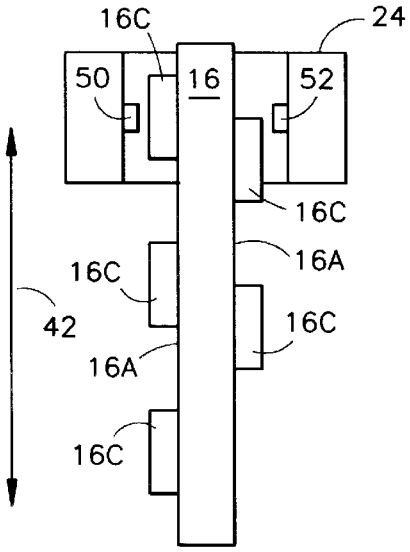
FIG.7B
FIG.8A
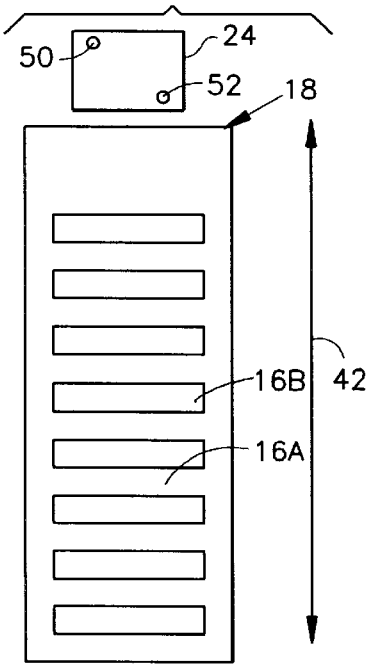
100 BINARY SIGNAL
| A | B |
|---|---|
| 0 | 0 |
| 0 | 1 |
| 96 GAP | |
| 1 | 1 |
| 1 | 0 |
| 0 | 0 |
| 0 | 1 |
| 1 | 1 |
| 1 | 0 |
| 0 | 0 |
| 0 | 1 |
| 1 | 1 |
| 1 | 0 |
| 0 | 0 |
| 0 | 1 |
| 1 | 1 |
| 1 | 0 |
| 0 | 0 |
| 0 | 1 |
| 1 | 1 |
| 1 | 0 |
| 0 | 0 |
| 0 | 1 |
| 1 | 1 |
| 1 | 0 |
| 0 | 0 |
| 0 | 1 |
| 1 | 1 |
| 1 | 0 |
| 0 | 0 |
| 1 | 0 |
| 0 | 0 |
FIG.8B

98 BINARY SIGNAL

| A | B |
|---|---|
| 0 | 0 |
| 0 | 1 |
| 0 | 0 |
| 0 | 1 |
| 1 | 1 |
| 1 | 0 |
| 0 | 0 |
| 0 | 1 |
| 1 | 1 |
| 1 | 0 |
| 0 | 0 |
| 0 | 1 |
| 1 | 1 |
| 1 | 0 |
| 0 | 0 |
| 0 | 1 |
| 1 | 1 |
| 1 | 0 |
| 0 | 0 |
| 0 | 1 |
| 1 | 1 |
| 1 | 0 |
| 0 | 0 |
| 0 | 1 |
| 1 | 1 |
| 1 | 0 |
| 0 | 0 |
| 0 | 1 |
| 1 | 1 |
| 1 | 0 |
| 0 | 0 |
| 1 | 0 |
| 0 | 0 |

METHOD FOR MONITORING ELEVATOR LEVELING PERFORMANCE WITH IMPROVED ACCURACY

TECHNICAL FIELD

This invention relates to monitoring of elevator leveling and more particularly to monitoring elevator leveling performance which has improvements in accuracy, ease and cost of installation, and which is feasible for the monitoring of elevator leveling at all floors.

BACKGROUND OF THE INVENTION

The existing method for determining leveling signals for remote elevator monitoring systems uses bar magnets at one floor and a magnetic proximity probe assembly comprising three proximity sensors typically installed on the top of an elevator car for ease of installation and maintenance. The magnets which excite the sensors are installed in a hoistway. Several mounting methods can be employed to affix the magnets. The magnets are typically glued and clamped to the rail.

Monitoring of elevator leveling determines how accurately the elevator car has stopped at a floor and is performed at one master floor in existing monitoring systems. A leveling signal as well as a controller derived direction of travel signal is sent to a counter which maintains a count that is used to keep track of elevator car position in the hoistway. A third signal, sync, is used as a reset to the counter thereby eliminating long term drift in the count caused by noise on a landing signal line.

Currently, the proximity probe assembly consists of three sensors. One sensor is used for determining elevator leveling at the master floor, one senses each landing or floor as the elevator car passes the floor, and the third is used to synchronize the counter. The array of three magnets is aligned so as to excite the three sensors and is typically installed on the first floor. At all other floors, only the magnet that triggers the landing signal is installed. The magnets are typically 15 cm in length.

An installation of the existing method would begin by affixing the magnetic proximity probe assembly to the top of the elevator car. Next, the magnets would be mounted in the hoistway at each floor either on the rail, on brackets, or on string supports. To position the magnets, the installer would, from the top of the elevator car, move the elevator car to the appropriate floor. He would determine that the elevator car is level at the floor by looking down the front of the elevator car and aligning the floor of the elevator car with the floor. This is an inexact method for installation because the width of an opening from the front of the elevator car to a front wall of the hoistway is only a few centimeters while the distance from the installer to the floor is over several meters. However, this is not critical because of the length of the magnets. It is critical that the elevator car be level with the floor when the sensor which detects landing detects the magnet at that floor.

One disadvantage of the current system is that it is inherently inaccurate due to the guesswork involved in determining when the elevator car is level at a floor as well as the positioning of the magnet. A second disadvantage is that the current system is expensive to install relative to the present invention. Another disadvantage is that leveling of the elevator car is performed at only one floor.

DISCLOSURE OF THE INVENTION

Therefore, there is a need for a method to monitor elevator leveling which is easier and less expensive to install, and which monitors leveling on all floors while yielding improved accuracy. The present invention addresses the aforementioned problems encountered with elevator leveling which the prior art has not addressed in an effective and satisfactory manner.

According to the present invention, level monitoring of an elevator car within a hoistway at a plurality of floors is accomplished by providing a plurality of sensed signals which is indicative of an elevator position of the elevator car relative to a plurality of targets having a plurality of light absorptive surfaces and a plurality of light interactive regions. The plurality of targets is mounted within the hoistway at the plurality of floors. The plurality of sensed signals is processed to provide a leveling signal, a floor number signal and a direction of travel signal which indicates a direction of travel of the elevator car within the hoistway. The leveling signal, floor number signal and direction of travel signal are stored at a remote elevator monitoring central processor. An optical sensing method, as employed in the present invention, provides improved accuracy over the magnetic sensing method employed in the prior art.

The method disclosed may comprise the step of calibrating the leveling signal, floor number signal and direction of travel signal as stored in the remote elevator monitoring central processor. The targets may be imprecisely installed at roughly the correct position at each floor and any resulting error compensated for in the calibration step. Thus installation becomes easier and less expensive which results in making the present invention feasible to install at each floor.

The step which provides sensed signals may comprise the steps of emitting light from an emitter which either reacts with the plurality of light interactive regions of the target or is absorbed by the plurality of light absorptive surfaces of the target and detecting the light after the light reacts with the plurality of the light interactive regions of the target by a corresponding detector. One or more of the corresponding detectors (which detect the light from one or more of the emitters and one or more of the emitters) form a sensor group.

The step of detecting the light after it reacts with the plurality of light interactive regions may comprise the step of receiving the light after the light passes through the plurality of light interactive regions of the target by a corresponding detector within the same sensor group as the emitter using a transmitted light detection technique. Each sensor group is offset from any other sensor group by a predetermined distance along a vertical axis in the direction of travel of the elevator car.

The step of detecting the light after it reacts with the plurality of light interactive regions may comprise the step of receiving the light after the light is reflected by the plurality of light interactive regions of the target by a corresponding detector within the same sensor group as the emitter using a reflected light detection technique. Either the sensor groups may be offset from each other or the plurality of light interactive regions may be offset from each other by a predetermined distance measured along the vertical axis in the direction of travel of the elevator car.

The step of providing sensed signals may comprise the step of determining a plurality of binary signals representing detection of the light emitted by one or more of the emitters and detected by one or more of the corresponding detectors within the same sensor group. A quadrature encoding technique is used which represents an absence of detected light by the corresponding detector from one or more of the emitters within the sensor group as a logic 0 state of the binary signals and a presence of detected light by the corresponding detector from one or more of the emitters within the sensor group as a logic 1 state of the binary signals.

The step of providing sensed signals may further comprise the step of calculating a sensor position of the sensor relative to the plurality of targets which is equivalent to the elevator position by maintaining a count of the binary signals and determining the leveling signal, floor number signal and direction of travel signal from the count.

The step of providing sensed signals may further comprise the step of synchronizing the count using one or more synchronization targets mounted within the hoistway at one or more of the plurality of floors which differ in a predetermined way from the plurality of targets.

These and other objects and advantages of the present invention will become apparent from a consideration of the ensuing drawings and description.

BRIEF DESCRIPTION OF THE DRAWINGS

In the drawings, closely related elements have the same number with additional alphabetic suffixes.

FIG. 2 shows a target, sensor and bracket in a hoistway via a top view looking down on the elevator car.

FIG. 3A shows a target and a schematic representation of a sensor employing a transmitted light detection technique.

FIG. 3B shows binary signals from sensor group A and sensor group B.

FIG. 3C shows sensed signals from sensor group A and sensor group B.

FIG. 7A shows an alternative embodiment of the present invention which employs a reflected light detection technique rather than a transmitted light detection technique wherein sensor groups are offset relative to each other.

FIG. 7B shows an alternative embodiment of the present invention which employs a reflected light detection technique rather than a transmitted light detection technique wherein light reflective strips on opposing sides of the target of FIG. 3A are offset relative to each other.

FIG. 8A shows an alternative embodiment of the present invention where a synchronization target is generated by omitting the first slot.

FIG. 8B shows second output states from sensor group A and sensor group B of FIG. 8A.

REFERENCE NUMERALS IN THE DRAWING FIGURES

Figure 1:
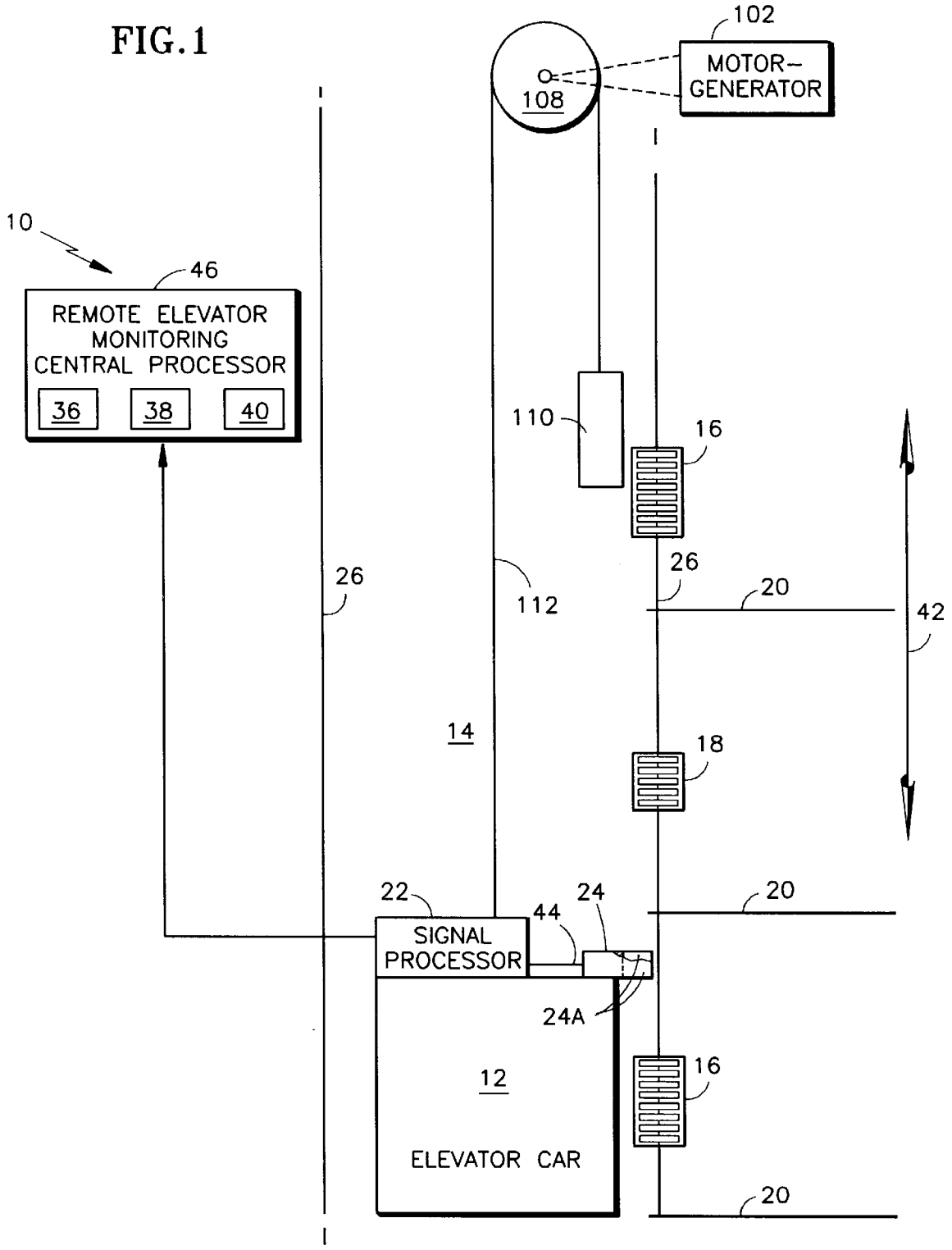
FIG. 1 shows a block diagram of an improved elevator car level monitoring system which employs the method of the invention for level monitoring of an elevator car.

10 improved elevator car level monitoring system
12 elevator car
14 hoistway
16 target
16A light absorptive surface
16B slot
16C light reflective strip
18 synchronization target
20 floor
22 signal processor
24 sensor
24A sensor leg
26 rail
28 binary signals
28A logic 0 state
28B logic 1 state
30 emitter
32 corresponding detector
34 sensor group
36 leveling variable
38 floor number variable
40 direction of travel variable
42 direction of travel
44 sensed signals
46 remote elevator monitoring central processor
48 target bracket
50 sensor group A
52 sensor group B
54 terminal J1-1
56 terminal J1-2
58 series resistor R1
60 terminal J1-3
62 terminal J1-4
64 transistor Q1
66 resistor R5
68 schmitt trigger
74 microprocessor controller
88 side to side axis
90 front to back axis
92 fixed rail clamp
94 sliding rail clamp
96 gap
98 first output states
100 second output states
102 motor-generator
104 node A
106 second microprocessor controller output port
108 pulley
110 counterweight
112 cable
114 circuit for sensor group A
116 circuit for sensor group B

BEST MODE FOR CARRYING OUT THE INVENTION

A typical elevator car 12 with an improved elevator car is level monitoring system 10 of the present invention is shown in FIG. 1 and depicts the hoistway 14 of a building with three floors 20 or landings. The elevator car 12 is guided in the hoistway 14 between two rails 26 and is supported by a cable 112 which travels over a pulley 108 and is attached to a counterweight 110. A motor-generator 102 either imparts energy to the pulley 108 or derives energy from the pulley 108 depending upon the weight of the counterweight 110 with respect to the elevator car 12 including its contents and a direction of travel 42 of the elevator car 12. A sensor 24 is mounted on the elevator car 12. One target 16 is mounted in the hoistway 14 at each floor 20. The elevator car 12 is shown just above the first floor 20. When the elevator car 12 stops at the first floor 20 the sensor 24 will be at some location with respect to the target 16. Sensed signals 44 from the sensor 24 are sent to a signal processor 22 mounted on the top of the elevator car 12 which serializes a count (described in greater detail in subsequent sections) and sends the serialized count to a remote elevator monitoring central processor 46. The serialized count may be sent via a hard-wired or wireless approach. The signal processor 22 is able to derive car velocity and acceleration from sensed signals 44. Although a cable driven elevator car 12 is shown in FIG. 1, the present invention is equally applicable to a hydraulic elevator which is well known in the art.

FIG. 2 shows the target 16 mounted on a target bracket 48 attached to the rail 26, however, the present invention is capable of being mounted to virtually any structure within the hoistway 14. The target bracket 48 consists of a fixed rail clamp 92 and a sliding rail clamp 94. Details for the attachment of the target 16 to the target bracket 48 will be provided in subsequent sections.

Figure 4A:
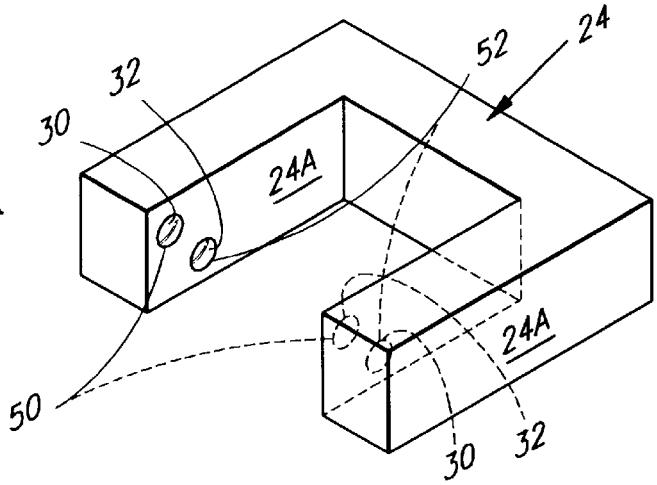
FIG. 4A shows an isometric view of the sensor of FIG. 3A which employs a crossfire arrangement of sensor groups.

The sensor 24 and target 16 are shown in FIG. 3A. The sensor 24 contains sensor group A 50 and sensor group B 52 both of which include an emitter 30 and a corresponding detector 32 as shown in FIG. 4. As the sensor 24 passes around the target 16, sensed signals 44, as shown in FIG. 3C, are output from the sensor 24. The vertical spacing of the corresponding detectors 32 in the direction of travel 42 (3 mm) and the width of light interactive regions in the direction of travel 42 (6 mm), which in this case (transmitted light detection technique) take the form of slots 16B, result in sensed signals 44 represented by binary signals 28 as shown in FIG. 3B that is a standard quadrature output with a resolution of 3 mm. Spacing between sensor legs 24A is typically 34 mm in order to accommodate ordinary elevator car 12 motion, and inaccuracies in installation of the target 16, synchronization target 18 or sensor 24. When leaving the target 16 at one floor 20 and also when entering the next target 16, binary signals 28 follow a standard quadrature pattern as shown in FIG. 3B and FIG. 3C. Quadrature sensing is a well known technique for accurately measuring position.

After the sensor 24, targets 16 and a synchronous target 18 are installed, the method of the present invention is calibrated. Calibration comprises the steps of stopping the elevator car 12 at each floor 20 and entering a floor number and position of the elevator car 12 relative to the floor 20 into the remote elevator monitoring central processor 46. Leveling data acquired in calibration is stored in non-volatile memory to avoid the necessity of repeated entry of the same value.

Sensor Head

The sensor 24 is shown in FIG. 4. One emitter 30 of sensor group A 50 and one corresponding detector 32 of sensor group B 52 are positioned on one sensor leg 24A and one emitter 30 of sensor group B 52 and one corresponding detector of sensor group A 50 are positioned on the remaining sensor leg 24A. Sensor group A 50 and sensor group B 52 are separated by 3 mm along a vertical axis in the direction of travel 42 of the elevator car 12 (e.g., vertical spacing) and 6 mm of horizontal spacing. The placement of sensor group A 50 and sensor group B 52 is defined as "cross firing" and was chosen to eliminate the chance of having the emitter 30 of sensor group A 50 incorrectly trigger the corresponding detector 32 of sensor group B 52 or vice versa.

The separation of the sensor legs 24A was chosen to eliminate mechanical interference as the target 16 passed between the legs 24A of the sensor 24 due to imprecise installation of the sensor 24 and target 16 while shielding the corresponding detectors 32 from ambient light. Sensor groups 34, which consist of sensor group A 50 and sensor group B 52, are recessed within the sensor legs 24A in order to protect the sensor groups 34 from potential damage, collimate the light, and to provide immunity to ambient light.

The emitter 30 and corresponding detector 32 operate within the infrared spectrum and are narrow optical bandwidth devices chosen for ambient light immunity. The emitter 30 features a narrow beam spread that improves transmission characteristics over the separation between the emitter 30 and the corresponding detector 32 that the present invention requires.

Sensor Electronics

Figures 5, 6:
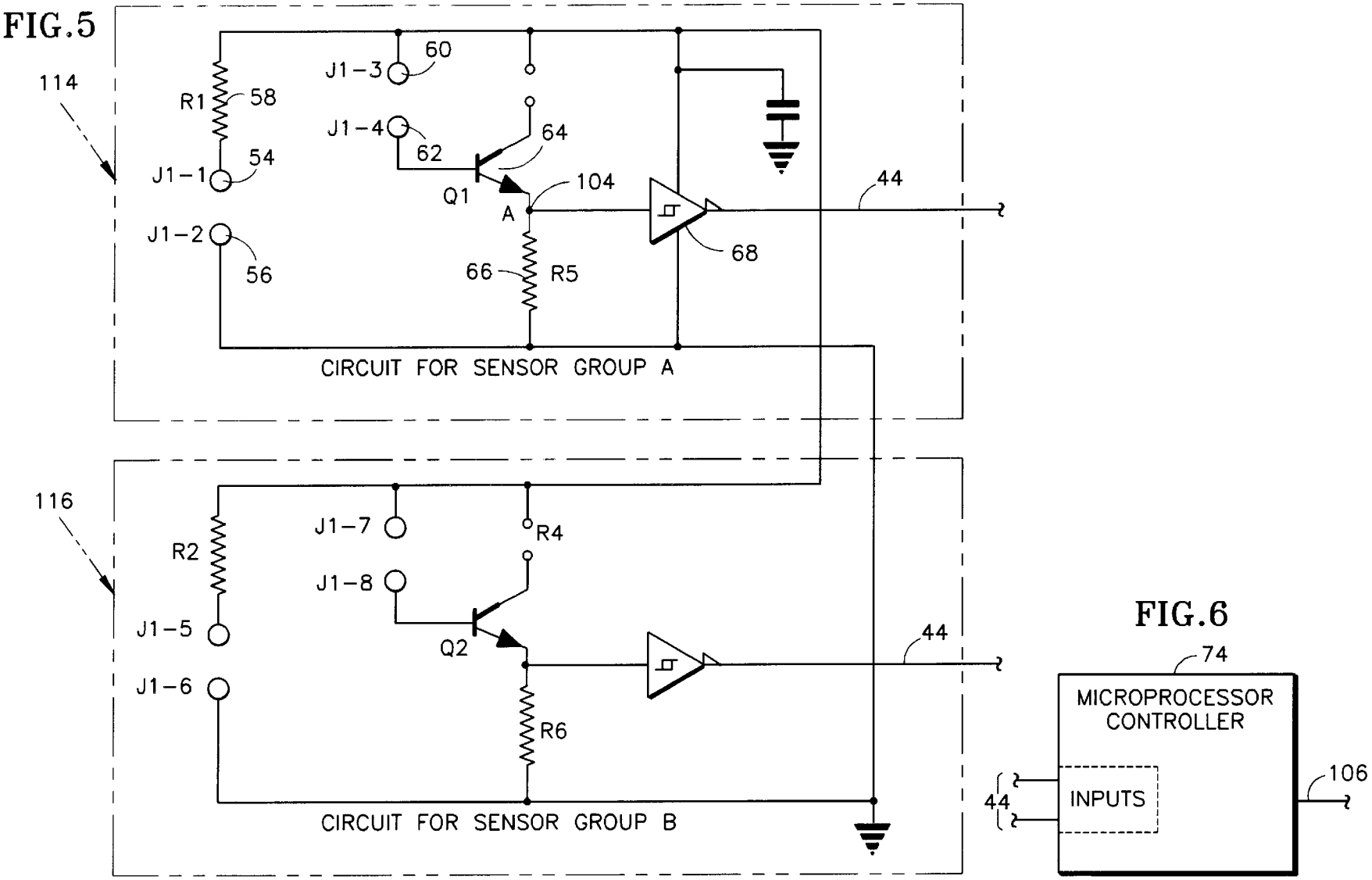
FIG. 5 shows a schematic for the circuits of sensor group A and sensor group B.
FIG. 6 shows a block diagram of a signal processor.

A circuit for sensor group A 114 and a circuit for sensor group B 116 is shown in FIG. 5 both being located within the sensor 24 in the preferred embodiment although a location remote to the sensor 24 is also feasible. The discussion which follows references the circuit for sensor A 114, however, the same principles are applicable to the circuit for sensor group B 116 as well.

The emitter 30 is excited by a direct current between terminal J1-1 54 and terminal J1-2 56. A series resistor R1 58 is chosen for a nominal excitation of 50 milli-amperes.

The corresponding detector 32 is formed between terminal J1-3 60 and terminal J1-4 62 and is a photo-diode which provides a current of approximately 12 micro-Amperes upon excitation. A transistor Q1 64 and resistor R5 66 create a voltage level at node A 104 which is compatible with standard TTL logic. A schmitt trigger 68 is used as a buffer and line driver to eliminate false triggers in noisy signals or those with slow rise and fall times.

Signal Processing

The microprocessor controller 74 scans the sensed signals 44 at a high sample rate (64 KHz) and requires that an input state be present for a specified number of successive reads (typically three) to debounce (provide noise immunity). The microprocessor controller 74 then looks at the previous state of the binary signal 28 to determine whether to increment or decrement the count as shown in FIG. 3B. A sequence such as shown in (1) is defined as an up direction count (i, an increase in the count):

$$(0,0)-(0,1)-(1,1)-(1,0)-(0,0). \quad (1)$$

A sequence such as shown in (2) is defined as a down direction count (i,e., decrease in the count):

$$(0,0)-(1,0)-(1,1)-(0,1)-(0,0). \quad (2)$$

Every 4 milliseconds, an updated count will be sent serially to the Remote Elevator Monitoring Central Processor 46 via a second microprocessor controller output port 106.

Remote Elevator Monitoring Central Processor

The remote elevator monitoring central processor 46 looks at successive counts to determine direction. Since length of the target 16 in counts is known, the remote elevator monitoring central processor 46 is able to determine the floor number from the count. For example, if the count for a target 16 is 100, then if the count is less than 100, the elevator car 12 is at the first floor 20. For counts between 100 and 200, the elevator car 12 is at the second floor, etc. The job of the remote elevator monitoring central processor 46 is to determine whether the present invention is still in synchronization and automatically correct the count if synchronization is required. From the above discussion, it is obvious that given knowledge of the target 16 length in counts, that the remote elevator monitoring central processor 46 is able to determine that there is only one valid count between each pair of targets, i.e., 100 between the targets 16 on the first and second floors 20. If the remote elevator monitoring central processor 46 detects that the count is incorrect between targets 16, it counts the length of the targets 16 by knowledge of the absence of counts between targets 16. Once the remote elevator monitoring central processor 46 determines that the synchronization target 18 has been passed, it re-initializes the count. The initialized count will be different for an up and down run. For example, 10 assuming the target 16 length is 100 and the synchronization target 18 is installed on the second floor 20 with a length of 110. When the synchronization target 18 is detected in the down direction the count is initialized to 100. When the synchronization target 18 is detected in the up direction the count is initialized to 210.

Design of the Target

The target 16 of FIG. 3A has been designed for detection of transmitted light as opposed to reflected light since slots 16B are used as light interactive regions as opposed to light reflective strips 16C as shown in FIG. 7A and FIG. 7B. This technique is advisable in environments where dirt and dust may accumulate on light reflective strips 16C causing a reflected light detection technique to fail. The target 16 as shown in FIG. 3A is 30 cm long with equally spaced 6 mm slots 16B on a 12 mm pitch. The width of the target 16 is 5 cm wide with slots 16B 4 cm wide to allow for inaccuracies in installation and twisted rails 26. The target 16 is made of optically absorptive plastic which creates a light absorptive surface 16A.

An embodiment for the target 16 and synchronization target 18 involves a generic design with perforations. The synchronization target 18 provides a positive resynchronization of the count and is broken off at the perforations while the target 16 remains the original length. This approach would need to distinguish between the sensor 24 passing the shorter synchronization target 18 at speed as opposed to coming to a floor 20 and only counting some of the slots 16B in the target 16 before coming to rest. A signal from the remote elevator monitoring central processor 46 indicating that the elevator car 12 has stopped is required. The advantage to this approach is that a single generic design can be used for both the target 16 and synchronization target 18.

Design of the Target Bracket for Holding the Target

The target bracket 48 for the target 16 or synchronization target 18 is installed on the rail 26 as shown in FIG. 2. The rail 26 is a convenient and consistent feature in all hoistways 14.

The target bracket 48 consists of a fixed rail clamp 92 that is permanently affixed to the target bracket 48 and a sliding rail clamp 94 which slides along a slot in the target bracket 48 for quick assembly. The target 16 or synchronization target 18 is mounted onto an arm which telescopes into the target bracket 48. This telescoping action allows overall length for tight installations to be minimized while providing flexibility for longer length applications. A gauge tool can be used for uniform placement of the target 16 and synchronization target 18 relative to the rail 26. Alternatively, the target 16 or synchronization target 18 may be mounted to a wall within the hoistway 14, in which case the target bracket 48 would be affixed directly to the wall thereby alleviating the need for clamps.

Installation Sequence

The length of the hoistway 14 must first be examined in order to choose a location for the target bracket 48 and target 16 which does not interfere with other hardware. The elevator car 12 is then moved to the first floor 20 and the target bracket 48 and target 16 installed onto a rail 26 at a chosen location. The sensor 24 is then installed so that the sensor 24 is approximately midway on the target 16 in all directions when the elevator car 12 is approximately level at the floor 20. The placement along the direction of travel 42 is not critical since this is compensated for by calibration. However, care must be taken with placement along the remaining two axes to insure that the target 16 lies midway between the sensor legs 24A of the sensor 16 and that a beam of emitted light between the emitter 30 and corresponding detector 32 of the same sensor group 34 is centered within the slot 16B. Typically the sensor 24 is provided with alignment markings to aid in positioning of the sensor 24 with respect to the target 16 and synchronization target 18. Alternatively, a target alignment gauge (TAG) can be used to adjust the distance between the rail 26 and the target 16. The elevator car 12 will then be moved to the second floor 20 and the installation of the synchronization target 18 will be carried out in the same manner as that of the target 16. Targets 16 should be installed on all floors 20 in the same manner.

Calibration of the Leveling Variable, Floor Number Variable, and Direction of Travel Variable During calibration the elevator car 12 must be moved to every floor 20 and a measurement taken. This measurement will be used to correct the count stored in the signal processor 22. The corrected value of the count indicates the count at which the elevator car 12 is level with the floor 20.

Calibration involves first moving the elevator car 12 along the entire length of the hoistway 14 in order to encounter the synchronization target 18 and thereby synchronize the count. The elevator car 12 is then moved to the first floor 20 and the floor number and the position of the elevator car 12 relative to the floor 20 are entered into the remote elevator monitoring central processor 46. The remote elevator monitoring central processor 46 then calculates a corrected count which corresponds to the leveling variable 36 at that floor. For example, assuming that the count is zero (0) at the first floor 20 and the elevator car 12 stopped 6 mm above the first floor 20 the corrected count would equal negative two (−2) which indicates that the desired floor 20 was two (2) steps of 3 mm each (i.e., 6 mm) below the elevator car 12 when the elevator car 12 stopped. The same procedure is followed for all floors 20.

Additional Embodiments

An additional embodiment would be to use a reflected light detection technique rather than the transmitted light detection technique described above. A different target 16 design would be required wherein the light interactive regions would be light reflective strips 16C affixed to both sides of the target 16 as shown in FIG. 7A and FIG. 7B. A different sensor 24 design would also be required wherein the emitter 30 and corresponding detector 32 of a particular sensor group 34 would be mounted on the same leg 24A of the sensor 24. The 3 mm offset which results in the binary signals 28 could be produced by either offsetting the light reflective strips 16C as shown in FIG. 7B or by offsetting the sensor groups 34 as shown in FIG. 7A.

Several modifications could be made to the sensor 24 and still be within the scope of this disclosure. For example, the emitters 30 could be pulsed rather than excited by a direct current. One advantage to pulsing is an improved life of the emitter 30 due to lower average power dissipation. A second advantage is an improved noise immunity achieved by increasing the amplitude of the pulse excitation to produce a higher light output. The greater amplitude permits the sensitivity of the corresponding detector 32 to be decreased which results in an improvement in ambient light immunity. Another advantage is the statistical improvement in the ambient light immunity due to the limited duration of sampling by the corresponding detector 32. One disadvantage of pulsing is that there is an increase in cost and complexity of the electronics to create the pulse and synchronize the corresponding detection. A second disadvantage is that the speed of operation of the pulsed system is limited. The minimum pulse width of the emitted light is determined by the optical delay of the corresponding detector 32. Frequency of the pulses is driven by the need to have a minimum of two (2) to four (4) pulses within the width of a slot 16B, but as the repetition rate increases the pulsed excitation approaches a direct current excitation.

Figure 4B:
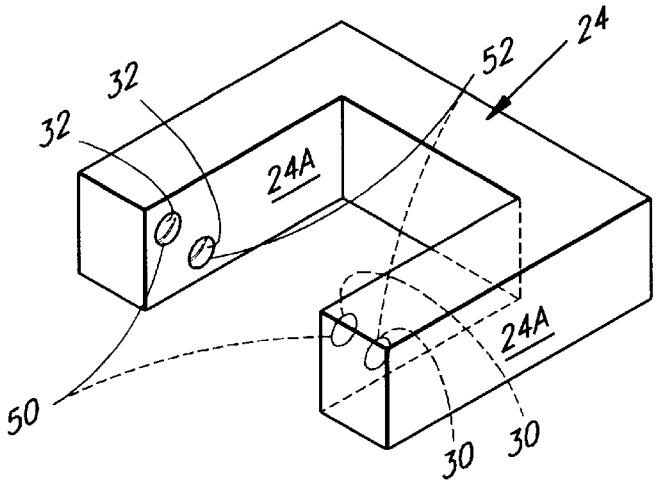
FIG. 4B shows an isometric view of the sensor of FIG. 3A which employs a parallel fire arrangement of sensor groups.

A second modification to the sensor 24 would involve mounting all of the emitters 30 of each sensor group 34 on one sensor leg 24A and all of the corresponding detectors 32 of each sensor group 34 on the other sensor leg 24A in a parallel fire arrangement of sensor groups 34 as shown in FIG. 4B. Although there may be a savings in cost associated with wiring the emitters 30 in parallel the corresponding detector 32 may be more susceptible to false triggering in this configuration.

Figure 4C:
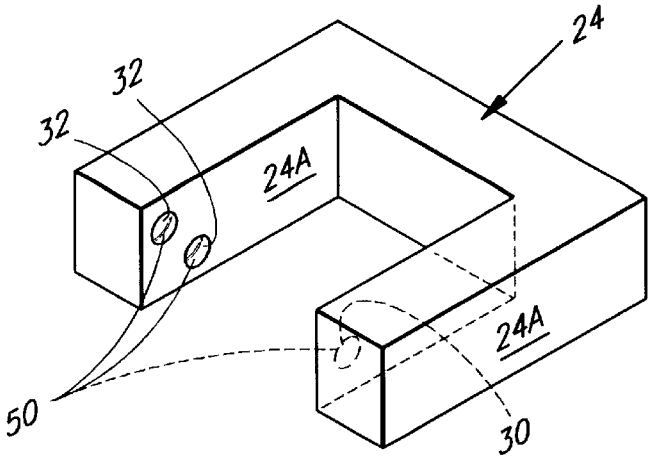
FIG. 4C shows an isometric view of the sensor of FIG. 3A which employs a single emitter dual corresponding detector arrangement of sensor groups.

A third modification to the sensor 24 would involve mounting one emitter 30 on one sensor leg 24A and mounting two corresponding detectors 32 on the remaining sensor leg 24A in a single emitter 30 dual corresponding detector 32 arrangement of sensor groups 34 as shown in FIG. 4C. The placement of the corresponding detectors 32 would retain the 3 mm vertical spacing in the direction of travel 42 between sensor groups 34 of the preferred embodiment. However, the horizontal spacing must be kept to a minimum. This modification would be less expensive to manufacture due to the reduced number of emitters 30, however, it may be more susceptible to false triggering. An alternative embodiment of the synchronization target 18 is designed to be slightly longer than the target 16 and would need to be manufactured separately from the target 16. A longer length is chosen because a shorter length may produce the same number of counts as if the elevator car 12 had stopped partially on a target 16. The synchronization target 18 is installed at only one floor 20 which can be neither the top nor bottom floor 20. The second floor 20 has been selected as the preferred site. Synchronization is required due to long term drift in the count or in the event the remote elevator monitor central processor 46 loses power and the elevator car 12 is moved. In an application of the present invention which involves only two floors 20, synchronization is not required, since the direction of travel variable 40 denotes whether the elevator car 12 is going to the first or second floor 20.

Synchronization could also be accomplished by a purely software based approach. During calibration the correct count for the top and bottom floors 20 could be determined and provided that the total number of targets 16 installed is known the count for all targets 16 could be determined. If the count exceeded a threshold the count could be reset to the value for the first floor 20 at every down call. Eventually, the elevator car 12 would reach the bottom floor and regain synchronization. In applications where the first floor 20 is seldom used (e.g., the basement), the top floor 20 could be used as an alternative. The disadvantage of this method is that floor leveling errors would be encountered while the count remains unsynchronized.

Another embodiment would involve a design of the sensor 24 and target 16 as shown in FIG. 8A and FIG. 8B. The sensor 24 of FIG. 8A separates the sensor groups 34 by a multiple of the slot 16B spacing. The separation is determined by equation (3) as follows:

$$\text{separation}=3\text{ mm}+(M*6\text{ mm}) \tag{3}$$

Figures 9A, 9B:
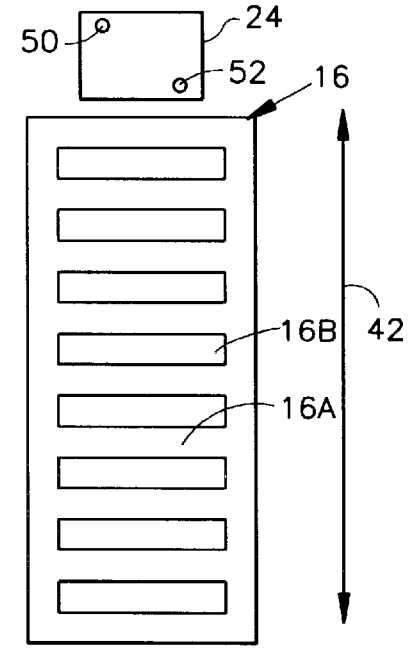
FIG. 9A shows an alternative embodiment of the present invention where the sensor of FIG. 4 contains sensor group A and sensor group B separated by a multiple of a slot spacing.
FIG. 9B shows first output states from sensor group A and sensor group B of FIG. 9A.

M may be any integer value. The case shown in FIG. 8A equates M to one (1). The output of this approach is a standard quadrature signal once both sensor groups 34 are on the target 16. During the period of time that the sensor groups 34 are only partially on the target 16 first output states 98 of FIG. 9B indicate a change in direction. The significance of this is that a synchronization target 18 can be generated by simply covering the first slot 16B on the target 16 as shown in FIG. 8A. It should be noted that first output states 98 of FIG. 9B and second output states 100 of FIG. 8B are identical except for the missing codes shown by a gap 96 in the second output states 100 of FIG. 8B. Therefore, a pattern recognition technique could be used to distinguish between the first output states 98 and the second output states 100, and thus between the target 16 in FIG. 9A and the synchronization target 18 in FIG. 8A.

An important feature of the present invention is that the sensed signal 44 is a quadrature square wave with as near 50% duty cycle as possible. The present invention provides the sensed signal 44 using a target 16 and a sensor 24 that trigger when half of the corresponding detector 32 is exposed to the emitter 30. An alternate approach would use a sensor 24 that triggers as soon as any of the corresponding detector 32 is exposed to the emitter 30. This sensor 24 arrangement would provide an asymmetric sensed signal 44. The asymmetry is corrected by adjusting the relative width of the light interactive regions while keeping the pitch between the light interactive regions the same. There may be some improvement in accuracy over the lifetime of the present invention by employing the asymmetric sensor 24 and target 16 described.

We claim:

1. A method for level monitoring of an elevator car within a hoistway at a plurality of floors, comprising the steps of:

providing a plurality of sensed signals which is indicative of an elevator position of said elevator car relative to a plurality of targets having a plurality of light absorptive surfaces and a plurality of light interactive regions, said plurality of targets mounted within said hoistway at said plurality of floors;

processing said plurality of sensed signals for providing a leveling variable, a floor number variable and a direction of travel variable which indicates a direction of travel of said elevator car within said hoistway; and storing said leveling variable, floor number variable and direction of travel variable at a remote elevator monitoring central processor.

2. The method of claim 1, wherein said step of providing a plurality of sensed signals comprises the steps of:

emitting light from an emitter which reacts with said plurality of light interactive regions of said target;

emitting said light from said emitter which is absorbed by said plurality of light absorptive surfaces of said target; and detecting said light after said light reacts with said plurality of said light interactive regions of said target by a corresponding detector, one or more of said corresponding detectors which detect said light from one or more of said emitters and one or more of said emitters forming a sensor group.

3. The method of claim 2, wherein said step of detecting said light comprises the step of receiving said light after said light is reflected by said plurality of light interactive regions of said target by a corresponding detector within said sensor group of said emitter.

4. The method of claim 3 further comprising the step of offsetting each sensor group from any other sensor group by a predetermined distance along a vertical axis in said direction of travel of said elevator car.

5. The method of claim 3 further comprising the step of offsetting each of said plurality of light interactive regions of said target by a predetermined distance measured along a vertical axis in said direction of travel of said elevator car.

6. The method of claim 2 further comprising the steps of:

determining a plurality of binary signals representing detection of said light emitted by one or more of said emitters and detected by one or more of said corresponding detectors within said sensor group;

representing an absence of detected light by said corresponding detector from one or more of said emitters within said sensor group as a logic 0 state of said binary signals; and representing a presence of detected light by said corresponding detector from one or more of said emitters within said sensor group as a logic 1 state of said binary signals.

7. The method of claim 6, further comprising the steps of:

calculating a sensor position of said sensor relative to said plurality of targets which is equivalent to said elevator position by maintaining a count of said binary signals; and determining said leveling variable, floor number variable and direction of travel variable from said count.

8. The method of claim 2, wherein said step of detecting said light comprises the step of receiving said light after said light passes through said plurality of light interactive regions of said target by a corresponding detector within said sensor group of said emitter, each sensor group being offset from any other sensor group by a predetermined distance measured along a vertical axis in said direction of travel of said elevator car.

9. The method of claim 1, further comprising the step of calibrating said leveling variable, floor number variable and direction of travel variable as stored in said remote elevator monitoring central processor.

10. A method for level monitoring of an elevator car within a hoistway at a plurality of floors, comprising the steps of:

providing a plurality of sensed signals which further comprises the steps of:

emitting light from an emitter which reacts with a plurality of light interactive regions of a target;

emitting said light from said emitter which is absorbed by a plurality of light absorptive surfaces of said target;

detecting said light after said light reacts with said plurality of said light interactive regions of said target by a corresponding detector, one or more of said corresponding detectors which detect said light from one or more said emitters and one or more of said emitters forming a sensor group;

processing said plurality of sensed signals for providing a leveling variable, a floor number variable and a direction of travel variable which indicates a direction of travel of said elevator car within said hoistway by:

determining a plurality of binary signals representing detection of said light emitted by one or more of said emitters and detected by one or more of said corresponding detectors within said sensor group;

representing an absence of detected light by said corresponding detector from one or more said emitters within said sensor group as a logic 0 state of binary signals;

representing a presence of detected light by said corresponding detector from one or more said emitters within said sensor group as a logic 1 state of said binary signals;

calculating a sensor position of said sensor relative to said plurality of targets which is equivalent to said elevator position by maintaining a count of binary signals;

determining said leveling variable, floor number variable and direction of travel variable from said count;

synchronizing said count using one or more synchronization targets mounted within said hoistway at one or more of said plurality of floors which differ in a predetermined way from said plurality of targets; and storing said leveling variable, floor number variable and direction of travel variable at a remote elevator monitoring central processor.

* * * * *